United States Patent [19]

Jaulmes

[11] 4,178,888

[45] Dec. 18, 1979

[54] CARBURETOR AND CRANKCASE ARRANGEMENT IN A SINGLE-CYLINDER TWO-STROKE ENGINE

[75] Inventor: Eric Jaulmes, Paris, France

[73] Assignee: Ateliers de la Motobecane S.A., Pantin, France

[21] Appl. No.: 902,226

[22] Filed: May 2, 1978

[30] Foreign Application Priority Data

May 6, 1977 [FR] France ..... 77 13836

[51] Int. Cl.[2] ..... F02B 33/04

[52] U.S. Cl. ..... 123/73 V; 123/73 A

[58] Field of Search ..... 123/73 R, 73 A, 73 V, 123/DIG. 3

[56] References Cited

U.S. PATENT DOCUMENTS

| | | | |
|---|---|---|---|
| 1,907,805 | 5/1933 | Heintz | 123/73 A |
| 1,912,574 | 6/1933 | Ewing | 123/73 V |
| 2,069,315 | 2/1937 | Irgens | 123/73 V |
| 2,218,332 | 10/1940 | Fowler | 123/73 A |
| 2,256,948 | 9/1941 | Lloyd et al. | 123/73 V |
| 2,421,198 | 5/1947 | Guardaldi | 123/DIG. 3 |
| 2,606,541 | 8/1952 | Lutz | 123/73 V |
| 2,639,699 | 5/1953 | Kiekhaefter | 123/73 V |
| 3,059,625 | 10/1962 | Torre | 123/73 V |

FOREIGN PATENT DOCUMENTS

| | | | |
|---|---|---|---|
| 450273 | 2/1949 | Italy | 123/73 A |
| 919132 | 2/1963 | United Kingdom | 123/73 V |

*Primary Examiner*—Wendell E. Burns

*Attorney, Agent, or Firm*—Browdy and Neimark

[57] ABSTRACT

A single-cylinder two-stroke engine having a carburetor, an intake tube leading into the crankcase, and an intake valve between the intake tube and the crankcase has its carburetor flow axis essentially parallel to the crankshaft axis and has the intake valve and the downstream part of the intake tube arranged so that their axis forms an acute angle with the planes perpendicular to the crankcase axis.

2 Claims, 4 Drawing Figures

CARBURETOR AND CRANKCASE ARRANGEMENT IN A SINGLE-CYLINDER TWO-STROKE ENGINE

FIELD OF THE INVENTION

The present invention relates to improvements to two-stroke engines.

BACKGROUND OF THE INVENTION

The present invention is aimed at resolving certain problems inherent in single-cylinder two-stroke engines with a valve intake into the crankcase via a carburetor and intake pipe, the engine elements being between two planes which are relatively close together and perpendicular to the engine crankshaft axis.

Such motors are found in particular in motorcycles wherein a magnetic flywheel on the one hand and the transmission elements which may comprise, for example, clutched and a speed governor, on the other hand, are mounted on the crankshaft axis on both sides of the cylinder. The engine is thus contained between two planes perpendicular to this axis, it being impossible to move the two planes apart at will for obvious space reasons.

On the other hand, to permit accessibility, the carburetor is generally mounted in such a motorcycle with its flow axis essentially parallel to the crankshaft axis, but the space occupied by this carburetor has meant that that far a flat valve has been used for admission of gases into the crankcase. It is known that such a valve has a plate in which an orifice is provided which can be blocked or cleared by means of a flexible blade. This valve, placed in the gas stream, has the disadvantage of causing turbulent flow and hence load losses, even if the flow-pipe axis is inclined with respect to the direction perpendicular to the plate.

Finally, in known engines of the above type the valve axis and the downstream part of the intake pipe which connects the carburetor outlet to the valve inlet are located in a plane perpendicular to the engine's crankshaft axis.

SUMMARY OF THE INVENTION

The purpose of the present invention is to achieve improved flow of the intake gases while retaining the advantages of a compact engine. For this purpose, the carburetor's flow axis in the engine according to the invention is essentially parallel to the crankshaft axis, the admission valve is a symmetric-flow valve, and the axis of the valve and of the downstream part of the exhaust pipe forms a certain acute angle with planes perpendicular to the crankshaft axis.

It has now been found that by inclining the valve axis with respect to the planes perpendicular to the crankshaft, it is possible to use a symmetrical valve, which is more favorable to flow, and the carburetor flow axis can be kept parallel to the crankshaft axis, while saving space in the engine in the direction of the crankshaft axis.

In a preferred embodiment of the present invention, the crankcase is made up of two parts with their joining plane perpendicular to the crankshaft axis, this joining plane intersecting the joining plane of the crankcase and the intake valve, the intake valve being secured to both of the crankcase halves.

Since the mounting of the intake valve concerns both crankcase halves, a better seal is achieved between the various elements and the valve is more securely mounted on the crankcase. In addition, the intersection between the joining plane of the two crankcase halves and the joining plane between the crankcase and the valve makes it easier to remove the intake pipe.

In one embodiment of the present invention, the joining plane of the two crankase halves is a certain distance from the plane of symmetry of the engine.

Under certain circumstances, this enables the intake valve to be mounted on both the crankcase halves.

BRIEF DESCRIPTION OF THE DRAWINGS

In any event, the invention will be understood with the aid of the description hereinbelow of one of its embodiments given as a nonlimitative example. In the attached drawings.

DETAILED DESCRIPTION OF A PREFERRED EMBODIMENT

Figure 1:
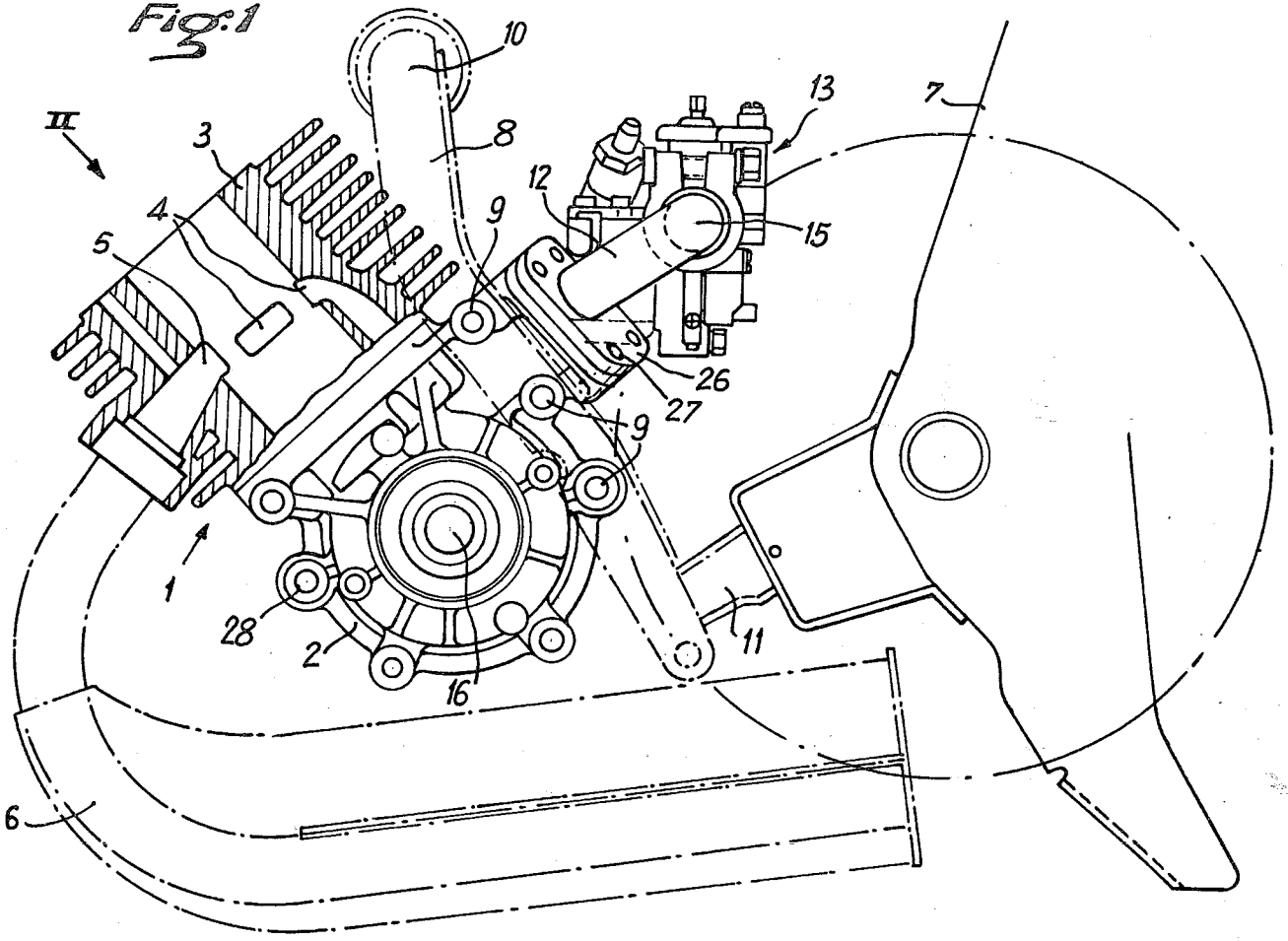
FIG. 1 is a side view of the engine assembly according to the present invention, partially in cross-section.

As shown more particularly in FIG. 1 of the drawings, an engine 1 according to the invention has, in general, crankcase 2 made of two crankcase halves and a cylinder 3. In this cylinder, transfer ducts 4 communicating with the inside of the pump crankcase and an exhaust pipe 5 connected to the engine's muffler 6 are arranged in known fashion.

The engine shown here is mounted on the chassis 7 of a motorcycle with the aid of a cradle 8 to which it is secured by bolts 9. Cradle 8 is itself connected to chassis 7 so that it can pivot about axis 10. The angular position of the engine is determined on the one hand by elastic means 11 and on the other hand by a transmission belt (not shown) mounted on the crankshaft. The elements limiting the transverse space taken up by the engine, namely the transmission devices and the magnetic flywheel, have not been shown.

The fresh gases are admitted into the crankcase via an intake tube 12 which connects the outlet of carburetor 13 to intake duct 14. Carburetor 13 is disposed in a manner known of itself such that its flow axis 15 is essentially parallel to crankshaft axis 16.

An intake valve 17 is mounted inside pipe 14 at the downstream end of tube 12. This valve is of the symmetric flow type, namely it has two flexible blades 18 (shown in their open position in FIG. 4) disposed symmetrically in the gas stream and essentially parallel thereto when they are open.

Figure 2:
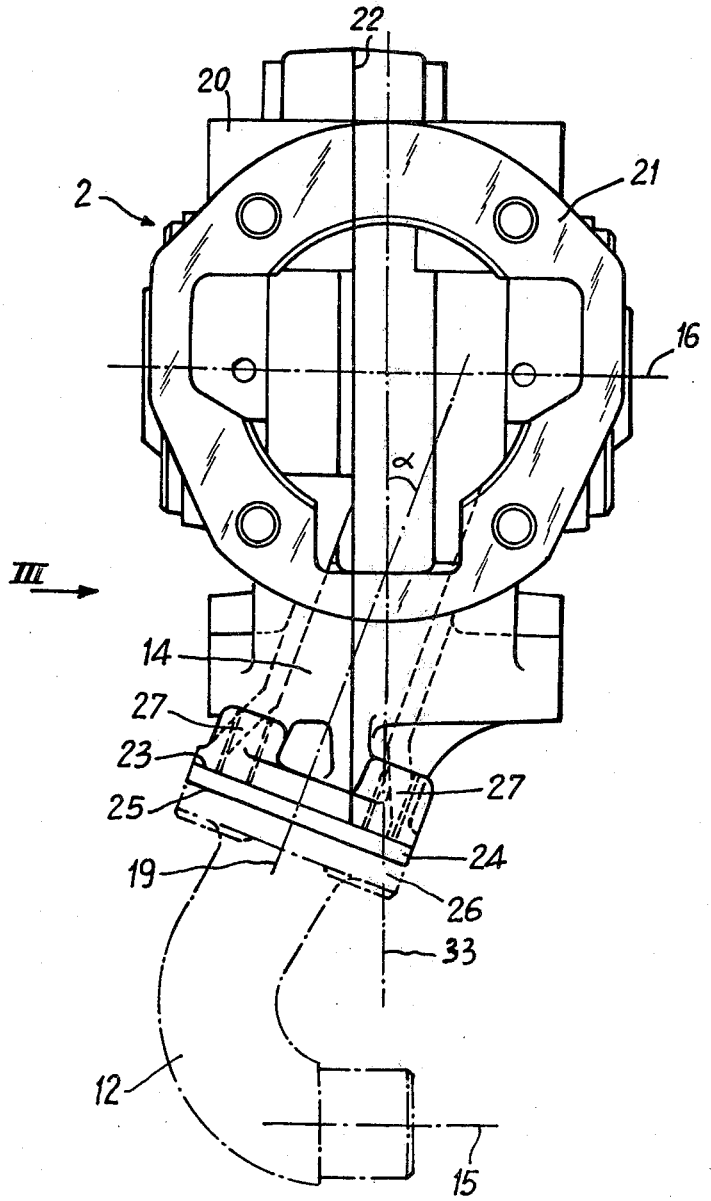
FIG. 2 is a view of the crankcase along arrow 2 of FIG. 1.
Figure 3:
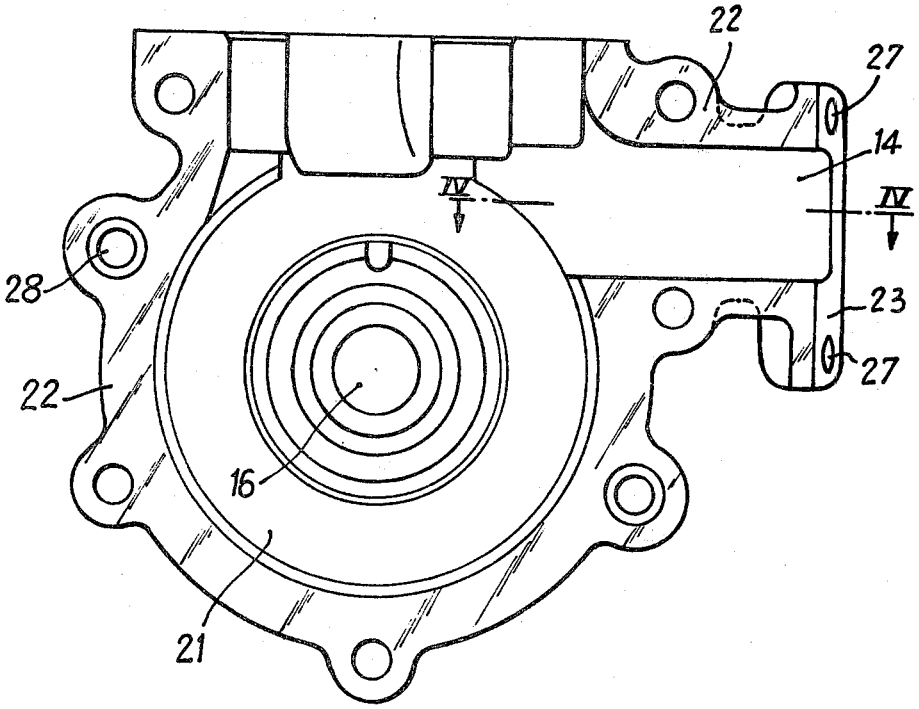
FIG. 3 is a view along arrow 3 of FIG. 2 of the crankcase half shown on the right part of FIG. 2.
Figure 4:
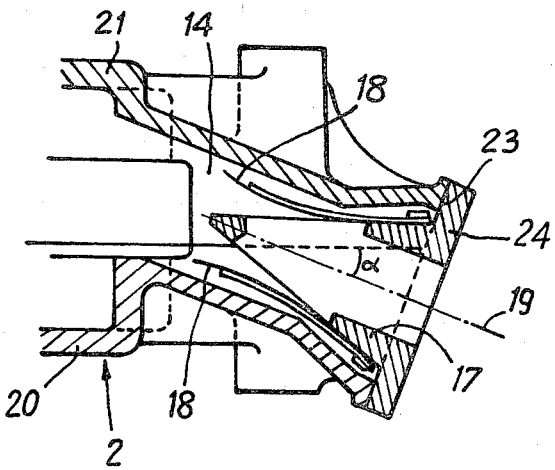
FIG. 4 is a cross section along line IV—IV in FIG. 3 of the assembly of the two crankcase halves plus the valve.

FIGS. 2 and 4 in particular show that the common axis 19 of valve 17 and the downstream end of tube 12 are not contained in a plane perpendicular to crankshaft axis 16, but on the contrary, forms an angle with these planes. When tube 12 is given an appropriate shape, carburetor 13 can be kept at a relatively small distance from the plane of symmetry of the engine.

Here, crankcase 2 is made of two parts 20 and 21 whose joining plane 22 perpendicular to crankshaft axis 16 is slightly shifted with respect to plane of symmetry 33 of crankcase 2. In this way, the joining plane 22 is enabled to intersect joining plane 23 formed between crankcase 2 and plate 24 of valve 17. The extension of joining plane 22 also intersects joining plane 25 formed between flange 26 provided at the downstream end of tube 12 and plate 24. The assembly formed by the two crankcase halves 20 and 21, valve 17, and tube 12, can be held in place by a screw 27 (not shown in FIG. 4) between the two crankcase halves. Of course, the two crankcase halves 20 and 21 are also held together by bolts 9 and other bolts 28 disposed at their periphery.

Joining plane 23 perpendicular to axis 19 of valve 17 and the downstream end of tube 12 is hence inclined with respect to joining plane 22, so that the two crankcase halves 20 and 21 can easily be removed.

It will be obvious to those skilled in the art that various changes may be made without departing from the scope of the invention and the invention is not to be considered limited to what is shown in the drawings and described in the specification.

What is claimed is:

1. In a single-cylinder two-stroke engine having a carburetor and an intake tube leading into the crankcase through an intake valve, the elements of the engine being located between two relatively close planes perpendicular to the crankshaft axis, the improvement wherein the carburetor flow axis is essentially parallel to the crankshaft axis, wherein the intake valve is of the symmetric type, wherein the axis of the intake valve and the axis of the downstream part of the intake tube form an acute angle with the planes perpendicular to the crankcase axis, wherein the crankcase is formed of two parts having their joining plane perpendicular to the crankshaft axis, and wherein said joining plane of the two crankcase parts intersects the joining plane of the crankshaft and the intake valve nonperpendicularly, the intake valve being mounted on both crankcase parts.

2. An engine in accordance with claim 1, wherein said joining plane of the two parts of the crankcase is slightly displaced from the plane of symmetry of the engine.

* * * * *